US006072751A

United States Patent [19]

Kirson et al.

[11] Patent Number: 6,072,751

[45] Date of Patent: Jun. 6, 2000

[54] ATHLETIC TRAINING DEVICE AND METHOD

[76] Inventors: Allan M. Kirson, 1040 Chaucer La., Highland Park, Ill. 60035; Gerald M. Crimmins, 7759 W. Berwyn, Chicago, Ill. 60656

[21] Appl. No.: 09/032,446

[22] Filed: Feb. 27, 1998

Related U.S. Application Data

[60] Provisional application No. 60/039,277, Feb. 28, 1997.

[51] Int. Cl.[7] ..... G04F 8/00; G04F 10/00; G04B 47/06; G08B 23/00

[52] U.S. Cl. ..... 368/2; 368/109; 368/110; 368/113; 340/323 R

[58] Field of Search ..... 368/2, 3, 10, 110–113; 340/323 R; 364/569

[56] References Cited

U.S. PATENT DOCUMENTS

| | | | |
|---|---|---|---|
| 3,596,103 | 7/1971 | Matthews et al. | 250/221 |
| 3,631,453 | 12/1971 | Stalp | 340/323 |
| 3,714,649 | 1/1973 | Brouwer et al. . | |
| 3,846,704 | 11/1974 | Bessette . | |
| 4,074,117 | 2/1978 | De Lorean . | |
| 4,451,896 | 5/1984 | Pomerleau | 364/569 |
| 4,523,204 | 6/1985 | Bovay | 346/107 B |
| 4,752,764 | 6/1988 | Peterson et al. | 340/323 R |
| 4,993,004 | 2/1991 | Loizeaux | 368/107 |
| 5,245,162 | 9/1993 | Takahashi | 235/377 |
| 5,293,354 | 3/1994 | Costabile | 368/11 |
| 5,349,569 | 9/1994 | Tanaka | 368/10 |
| 5,367,286 | 11/1994 | Voillat | 340/323 R |
| 5,436,611 | 7/1995 | Arlinghasu, Jr. | 340/323 R |
| 5,812,049 | 9/1998 | Uzi | 340/323 R |

*Primary Examiner*—Vit Miska
*Attorney, Agent, or Firm*—Marshall, O'Toole, Gerstein, Murray & Borun

[57] ABSTRACT

An athletic training device includes a main control unit coupled to one or more finish line units via a communication link. The main control unit arranged to provide a pre-race start signal and a race start signal simulating an actual race event starting condition. The main control unit further arranged to time the race events, to determine reaction times and to measure weather and/or atmospheric conditions and to store all these as training statistics.

23 Claims, 4 Drawing Sheets

ATHLETIC TRAINING DEVICE AND METHOD

This application claims benefit of provisional application No. 60/039,277 Feb. 28, 1997.

FIELD OF THE INVENTION

The present invention relates generally to athletic training devices and more particularly to an athletic training apparatus simulating race conditions.

BACKGROUND OF THE INVENTION

Athletes train to ready themselves both physically and mentally for competition. Mental preparation and readiness are nearly as important as physical strength and ability. Many athletes will relate that it is the mental edge which provides the difference between victory and defeat. With this in mind athletes not only train vigorously to prepare physically for competition, but also train mentally by attempting to simulate as closely as possible the actual conditions of competition.

Participants of timed events have long relied on timed training events to ready themselves for competition. Timed events provide an ability to measure improvement and to record performance. To properly conduct these training activities, however, the athlete has to rely on either a coach or training partner for assistance. When the athlete is left to train alone, the athlete either has to forego timed training or attempt to provide timing and race simulation on his own. Self-timing of events is very difficult and often prone to error. Simulating race conditions is nearly impossible.

Timing devices have been proposed to assist in timing racing events. For example, U.S. Pat. No. 3,596,103 discloses a system for automatically recording race times for several race participants. The device includes a structure for aligning a plurality of photocell/light beam devices with the lanes of the race course. As participants pass the structure the circuit breaking element interrupts a timer associated with that lane. The timing devices are simultaneously started as a result of a race participants motion away from the starting blocks. A swimming race timing device is disclosed in U.S. Pat. No. 5,349,569. The device includes a start signal generator, a block signal generator for detecting when the swimmers feet leave the platform and a touch panel for producing a stop signal. The touch panel is specifically designed to be responsive to touches at oblique angles. While these devices may potentially provide assistance in timing training events, each fails to provide the athlete with an accurate simulation of the competition.

Another aspect of training is recording training performances in order to monitor improvement and target training to areas needing specific improvement. The traditional method sees the coach or training partner manually keeping detailed training statistics. Often, however, the coach is unable to measure and record all of the relevant training statistics. Several known race timing devices provide some capability for recording and keeping statistics on elapsed event time. U.S. Pat. No. 4,523,204 discloses a system for timing a race and recording race data including start, reaction time and arrival times. This device further discloses recording ambient conditions such as wind speeds.

Athletes achieve peak performance in competition by training under conditions which most closely simulate actual competition, by learning their weaknesses and targeting further training in those areas. To accomplish such training requires conditions simulating competition and detailed record keeping. Unfortunately for these athletes, and particularly for the athlete training solo, training aids do not exist which allow for close simulation of race conditions, timing and record keeping.

SUMMARY OF THE INVENTION

The present invention provides the athlete with a training device that closely simulates racing conditions. That is, it provides simulated pre-race readying and race start conditions coupled with accurate timing of various race aspects. The present invention further provides for recording statistics relating to the simulated race event including performance measurements as well as ambient condition measurements. The features of the device are packaged such as to allow the athlete to train individually or with the participation of a coach or partner offering a great advantage over prior training devices.

DETAILED DESCRIPTION OF THE PREFERRED EMBODIMENT

The present invention is described in terms of a preferred embodiment adapted for use in sprint race training. It should be appreciated, however, that the broad teachings of the present invention extend beyond the preferred implementation described herein. For example, the invention may be adapted for use in the training and participation of any type of timed competition such as swimming.

Figure 1:
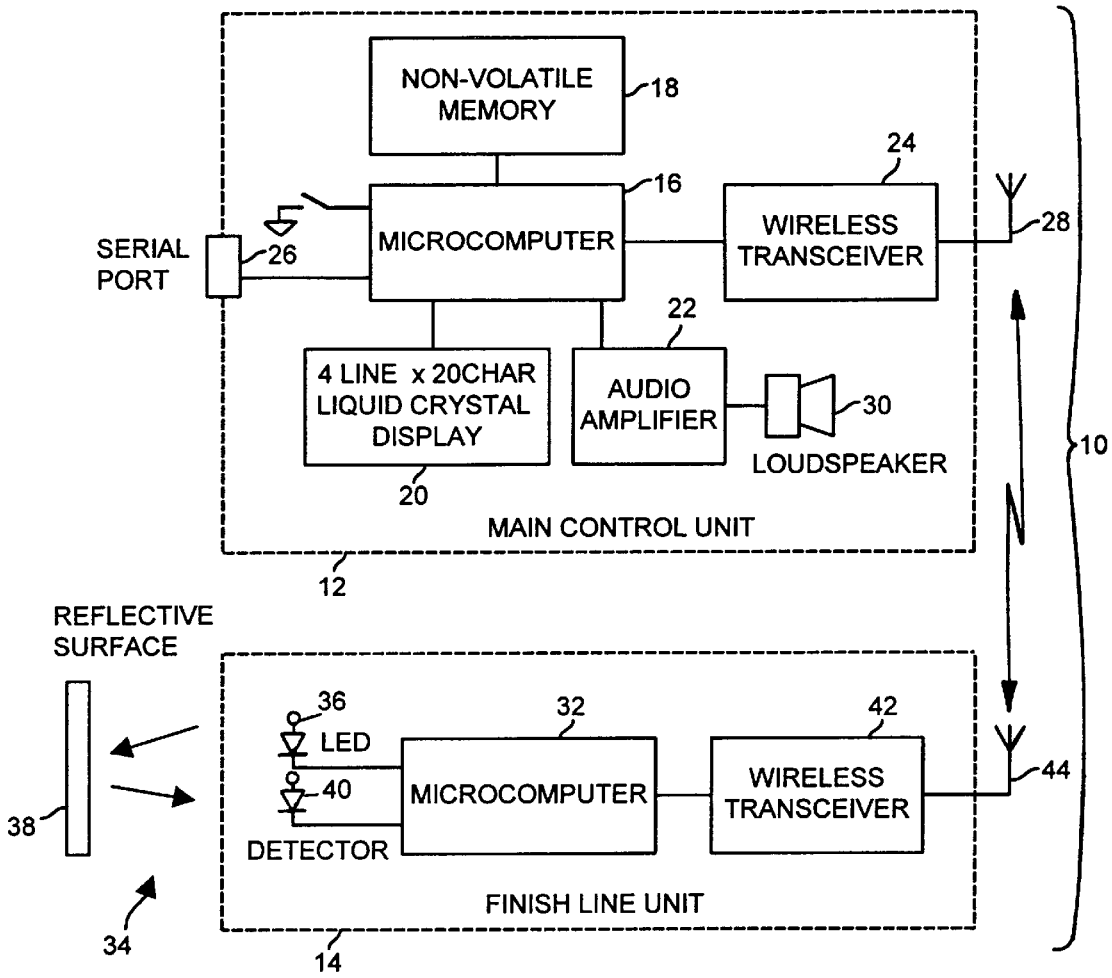
FIG. 1 is a block diagram illustrating training device in accordance with a preferred embodiment of the present invention.

With reference to FIG. 1, training device 10 is shown and includes a main control unit 12 and a finish line unit 14. Main control unit 12 includes a microcomputer 16 operating a set of program instructions which may be provided to it from non-volatile memory 18, or more preferably retained directly within memory associated with microcomputer 16 in the form of microcode. Microcomputer 16 is preferably a 68HC05 microprocessor available from Motorola, Inc of Schaumburg, Ill. and is coupled to liquid crystal display (LCD) 20, audio amplifier 22, wireless transceiver 24 and serial port 26. Main control unit 12 as with finish line unit 14 are provide with a suitable source of electrical power such as battery packs, solar cells or AC adapters (not shown). Wireless transceiver 24 is further coupled to antenna 28, and audio amplifier 22 is coupled to loudspeaker 30. Start switch 11 initiate operation of microcomputer 16 and hence execution of the program instructions. In the preferred embodiment, microcomputer 16 provides for self-shutdown after a period of inactivity or through operation of switch 11.

Finish line unit 14 includes a microcontroller 32 adapted to a photoelectric trigger device 34 which includes a light emitting diode 36, reflective surface 38 and detector 40. Microcontroller 32 is further coupled to wireless transceiver 42, which is coupled to antenna 44. It will be appreciated that several finish line units 14 may be employed and arranged in various configurations. For example, a first finish line unit 14 may be arranged to provide a signal at an interval along a race course and a second finish line unit 14 may be arranged to provide a race finish signal. Or, a first finish line unit 14 may be arranged to provide a race finish signal from a first racing lane while a second finish line unit 14 may be used to provide a second race finish signal from a second racing lane. Finish line unit 14 may also be adapted to provide several race finish signals, each such race finish signal being associated with each of a plurality of racing lanes.

Figure 3:
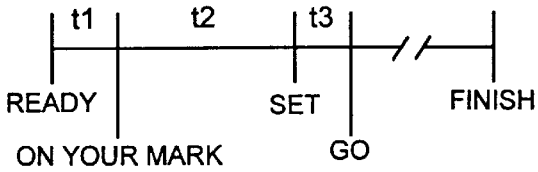
FIG. 3 is timing diagram further illustrating a race condition simulation in accordance with a preferred embodiment of the present invention.

Referring now to FIG. 3 the timing of a typical race event is shown. At the "ready" position, the athlete is given a command to ready herself in the starting blocks. After a period of time, t1, the "on your mark" command is given. The "on your mark" command is then followed by another period of time t2 when the "set" command is given. Following the "set" command and a period of time t3, the "go" command is given. The race takes place over a measured elapsed time until the finish. The time periods t2 and t3 are typically a nominal value plus or minus some random variant. In actual racing conditions the random nature of the time periods is introduced by the starter. This random variation in the starting sequence, however, greatly effects the athletes reaction time to the "go" command, and hence, her overall performance.

The present invention provides for complete race conditions simulation by providing a "ready" command and each of the "on your mark", "set" and "go" commands given in an actual race. In addition, the present invention provides for introducing a random nature to the time periods existing between each of these commands to provide a close simulation of actual racing conditions.

Figure 2:
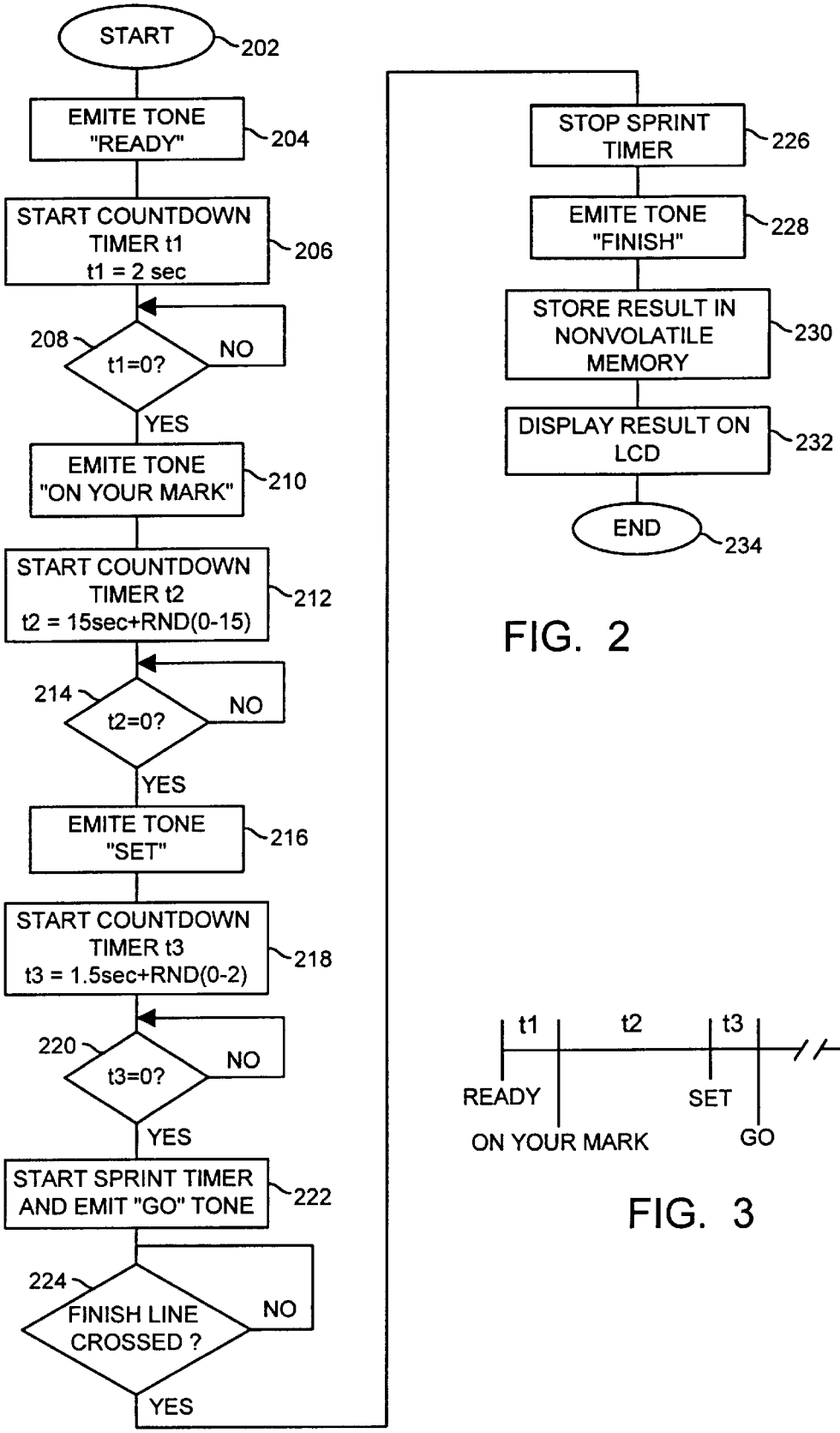
FIG. 2 is a flow diagram of a race condition simulation in accordance with a preferred embodiment of the present invention and as implemented in the training device of the present invention.

The flow diagram of FIG. 2 illustrates the program instructions 200 operated on by microcomputer 16. At the start, step 202, upon operation of switch 11 microcomputer 16 provides a "ready" tone signal, step 204, to audio amplifier 22 which causes loudspeaker 30 to emit the audible "ready" tone. The ready tone is preferably any tone well within the audible range and at a suitable volume to be heard over a distance of several meters. It will be appreciated that in the preferred implementation tone signals are used to instruct the athlete through the various aspects of the race simulation. However, other signals such as voice commands may be use without departing from the fair scope of the present invention.

After the time period t1, preferably a fixed time period, determined by a countdown timer, steps 206 and 208, microcomputer 16 sends an "on your mark" signal to audio amplifier 22 causing loudspeaker 30 to emit the "on your mark" tone, step 210. The "on your mark" tone is again preferably any audible tone at a suitable volume and preferably different from the "ready" tone.

Next microcomputer 16 executes a second countdown timer, steps 212 and 214. The time period t2, of the second countdown timer is set equal to approximately 15 second plus a random number of seconds (preferably about 0–15 seconds). The time period t2 therefore varies in the range of approximately 15 to 30 seconds.

Following the time period t2, microcomputer 16 sends a "set" signal to audio amplifier 22 causing loudspeaker 30 to emit the "set" tone, step 216. The "set" tone is again preferably any audible tone at a suitable volume and preferably different from each of the "ready" and "on your mark" tones.

Microcomputer 16 executes a third countdown timer, steps 218 and 220. The time period t3, of the third countdown timer is set equal to approximately 1.5 seconds plus a random number of seconds (preferably about 0–2 seconds). The time period t3 therefore varies in the range of approximately 1.5 to 3.5 seconds.

Following time period t3 microcomputer 16 sends a "go" signal to audio amplifier 22 causing loud speaker 30 to emit a "go" tone and substantially simultaneously starts a sprint timer, step 222. The "go" is again preferably any audible tone at a suitable volume and different from each of the "ready", "on your mark" and "set" tones.

With the sprint timer running, the race is underway until the athlete crosses the finish line. The finish line crossing is sensed as the athlete breaks a light beam generated by photoelectric trigger device 34. In the preferred embodiment, main control unit 12 sends the "go" signal to finish line unit 14 to activate photoelectric trigger device 34. Alternatively, photoelectric trigger device 34 may be pulsed at a high frequency to reduce energy consumption. When the light beam is broken, microcontroller 32 generates a "finish" signal to transceiver 42 which communicates via antennas 44 and 28 to transceiver 24 in the main control unit, step 224. Transceiver 24 receives the "finish" signal and communicates it to microcomputer 16 which stops the spring timer, step 226.

With the race complete, microcomputer 16 sends the "finish" signal to audio amplifier 22 causing loudspeaker 30 to emit a "finish" tone, step 228. The results of the race, i.e., the race time is stored in the non-volatile memory 18, step 230, and displayed on LCD 20, step 232. The program instructions then end, step 234.

Through manipulation of switch 11, the athlete may review the last or other previously stored race data. That is, by depressing switch 11 in specified sequences microcomputer 16 will cause race data stored in non-volatile memory 18 to be displayed on LCD 20. As will be described in more detail later, the data may be further downloaded to a personal computer or the like for further analysis.

It should be appreciated that the time periods and random variants are selected to closely simulate actual racing conditions. Different time values may be employed without departing from the fair scope of the present invention.

Figure 4:
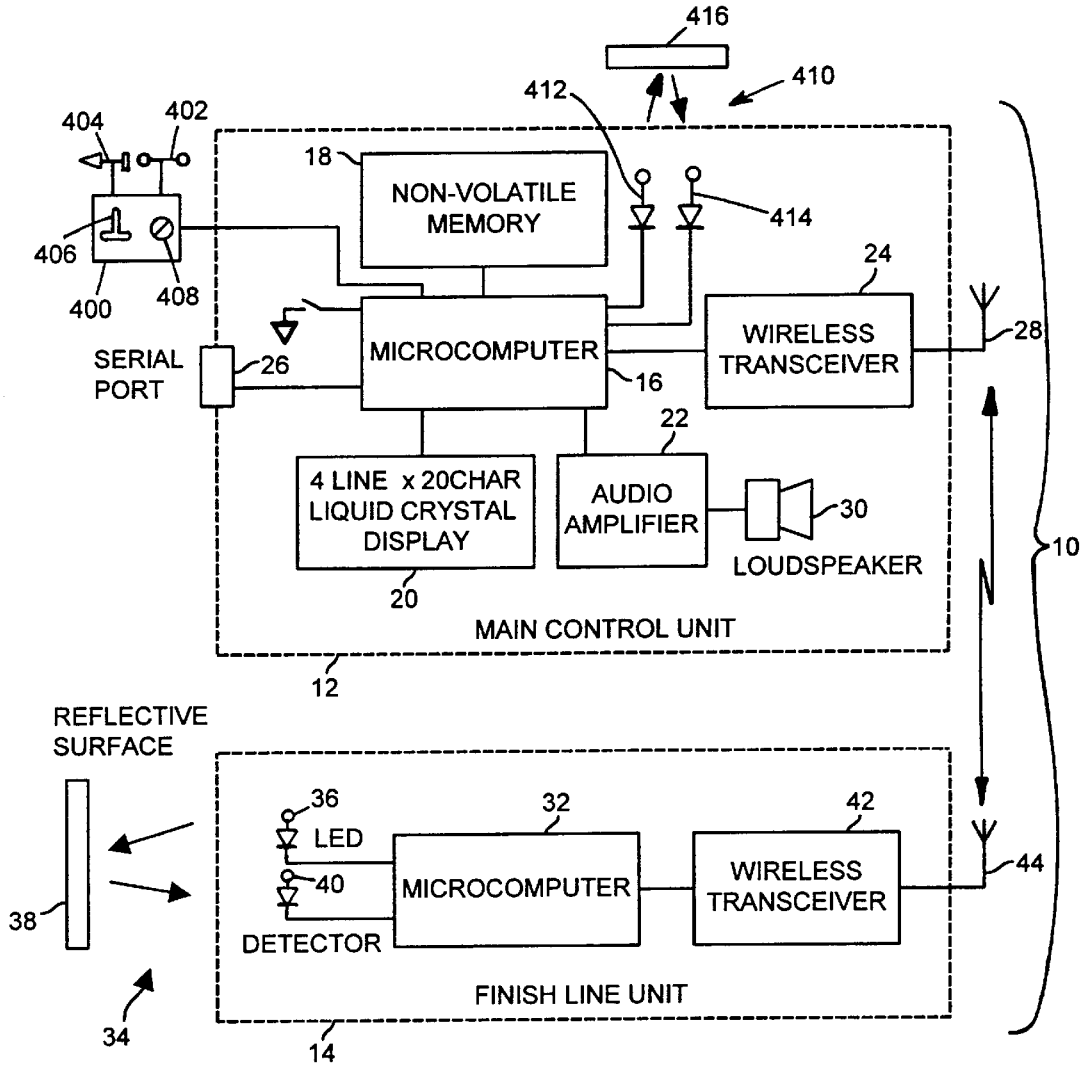
FIG. 4 is a block diagram illustrating an alternate training device in accordance with a preferred embodiment of the present invention.

Referring now to FIG. 4 and alternate embodiment of the main control unit and the finish line unit in accordance with a preferred embodiment of the present invention is shown. For ease of understanding this additional embodiment, like reference numerals are used to describe like elements of the preceding embodiments. As seen in FIG. 4, main control unit 12 is now adapted with weather data unit 400. Weather and atmospheric monitoring unit 400 includes wind speed sensor 402, wind direction sensor 404, temperature sensor 406 and humidity sensor 408 and is coupled to microcomputer 16. Other weather and atmospheric measurements may be added without departing from the fair scope of the invention such as barometric pressure, precipitation, etc. Upon activation of main control unit 12, each of the sensors, 402–408, provide a signal to microcomputer 16 indicative of the weather conditions during the race simulation. These conditions are stored in non-volatile memory 18 in association with other race data.

FIG. 4 further illustrates photoelectric trigger device 410 coupled to main control unit 12. Photoelectric trigger device 410 includes LED 412, detector 414 and reflective s surface 416. Photoelectric trigger device 410 is adapted to sense when the athlete crosses the starting line. In conjunction with the "go" signal, microcomputer 16 may determine a false start situation and provide a suitable audio signal. In addition, under a proper start, microcomputer 16 determines a reaction time which is recorded in the non-volatile memory.

Race and weather/atmospheric data is preferably stored within non-volatile memory 18 in a cyclic buffer arrangement. Newer data overwrites older data with a limited number of race data being retained. With reference once again to FIG. 1, microcomputer 16 has associated directly therewith non-volatile memory and random access memory. Preferably this memory associated with microcomputer 16 is used to retain both the program instructions and the race and weather data. However, if it is desired to retain additional data additional non-volatile memory 18 preferably in the form of an EEPROM device may be provided.

Figure 5:
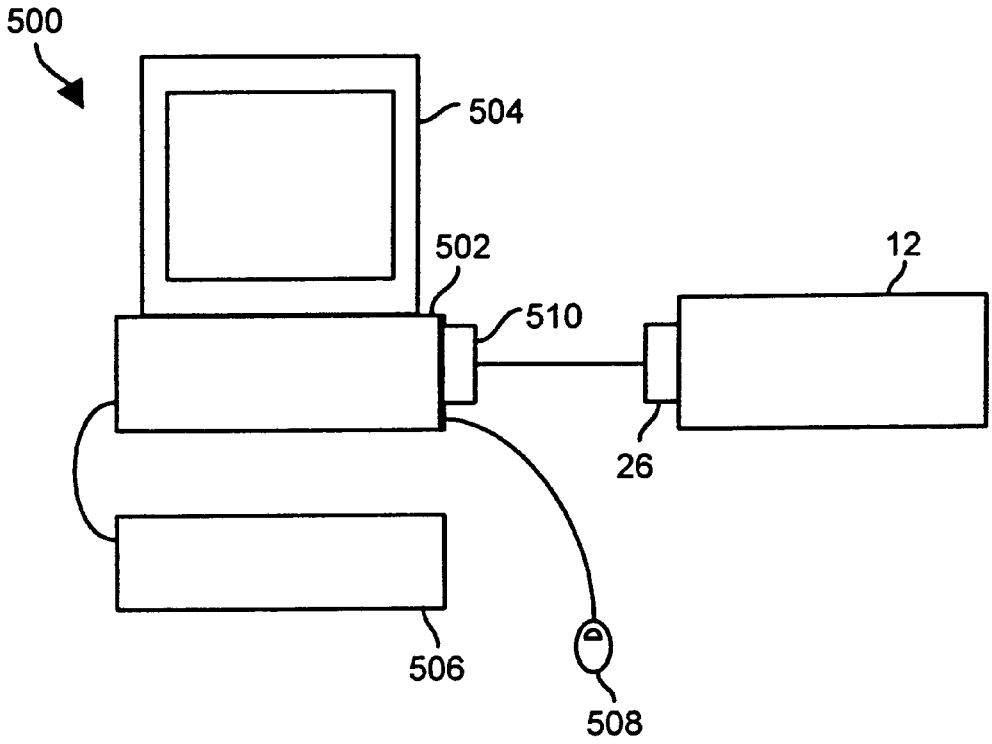
FIG. 5 is a schematic illustration of the training device of the present invention coupled to a general-purpose computer in accordance with a preferred embodiment of the present invention.

With reference now to FIG. 5, main control unit 12 is shown coupled via serial port 26 to a serial port 510 associated with computer 500 that includes a main processing unit 502 including memory, a display device 504, and input devices (keyboard and mouse) 506 and 508. Computer 500 is preferably any general purpose computer, such as a personal computer, adapted to interrogate microcomputer 16 and non-volatile memory 18 and to download race data therefrom. In the preferred embodiment, race data is download from memory 18 into a commercially available spreadsheet program such as Microsoft Excel spreadsheet program. Within the spreadsheet program the data may be manipulated within computer 500 to identify trends and other significant training indicators. Such statistics may include minimum and maximum race times, average times, reaction times, race times in relation to weather parameters and other significant indicators, which will assist the athlete in improving performance.

Many changes and modifications could be made to the invention without departing from the fair scope and spirit thereof. The scope of some changes is discussed above. The scope of others will become apparent from the appended claims.

What is claimed is:

1. An athletic training device comprising:

a main control unit and at least one finish line unit, the main control unit and the finish line unit coupled via a communication link; and the main control unit arranged to provide a pre-race start signal a race start signal simulating an actual event starting condition and a random time period between the pre-race start signal and the race start signal, the main control unit further arranged to time a race event, the race event comprising a time period extending between the race start signal and a race finish signal, the race finish signal being generated by the finish line unit and coupled from the finish line unit to the main control unit.

2. The athletic training device of claim 1 comprising at least a first finish line unit and a second finish line unit, the first finish line unit arranged to generate a race interval signal and to communicate the race interval signal to the main control unit and the second finish line unit arranged to generate the race finish signal.

3. The athletic training device of claim 1 comprising at least a first finish line unit and a second finish line unit, the first finish line unit arranged to generate a first race finish signal in a first race lane and to communicate the first race finish signal to the main control unit and the second finish line unit arranged to generate a second race finish signal in a second race lane and to communicate the second race finish signal to the main control unit.

4. The athletic training device of claim 1, wherein the pre-race start signal comprises at least one of a "ready" signal, an "on your mark" signal, and a "set" signal.

5. The athletic training device of claim 1, wherein the race start signal comprises a "go" signal.

6. The athletic training device of claim 1, wherein each of the pre-race start signal and the race start signal comprises one of an audio tone and a voice command.

7. The athletic training device of claim 1, wherein the communication link comprises one of a wireless link and a wired link.

8. The athletic training device of claim 1, wherein the pre-race start signal comprises a first pre-race start signal and a second pre-race start signal, and wherein the random time period comprises a first random time period between the first pre-race start signal and the second pre-race start signal and a second random time period between the second pre-race start signal and the race start signal.

9. The athletic training device of claim 1, wherein the pre-race start signal comprises a first pre-race start signal and a second pre-race start signal, and wherein the random time period comprises a fixed time period between the first pre-race start signal and the second pre-race start signal and a random time period between the second pre-race start signal and the race start signal.

10. The athletic training device of claim 1, wherein the finish line unit comprises a detector arranged for detecting a crossing of a finish line by a training athlete.

11. The athletic training device of claim 1, wherein the main control unit comprises a detector arranged for detecting a leaving of a start position by a training athlete.

12. The athletic training device of claim 1, the main control unit arranged for storing training statistics.

13. The athletic training device of claim 12, wherein the training statistics comprises at least one of a race elapsed time and a reaction time.

14. The athletic training device of claim 12, the main control unit arranged for communicating the training statistics to a general purpose computer.

15. The athletic training device of claim 1, the main control unit and the finish line unit being powered by one of a battery power source, a solar power source, and an alternating current power source.

16. The athletic training device of claim 1, the main control unit being responsive to a sequence begin signal for providing the pre-race start signal and the race start signal.

17. An athletic training device comprising:

a main control unit and at least one finish line unit, the main control unit and the at least one finish line unit coupled via a communication link;

the at least one finish line unit arranged to detect a crossing of a finish line by a training athlete, to generate a finish signal and to communicate the finish signal to the main control unit via the communication link;

the main control unit arranged to provide a first pre-race start signal, a second pre-race start signal, a third pre-race start signal and a race start signal including a fixed time period between the first pre-race start signal and the second pre-race start signal, a first random time period between the second pre-race start signal and the third pre-race start signal and a second random time period between the third pre-race start signal and the race start signal;

the main control unit further arranged to time a race event, the race event comprising a time period extending between the race start signal and the race finish signal, and for saving a race event elapsed time as a training statistic; and the main control unit further arranged to determine a reaction time, to measure weather and atmospheric conditions and to store the reaction time and weather and atmospheric conditions in association with the race event elapsed time as training statistics.

18. A method of simulating a race event for training purposes, the method comprising:

initiating a race simulator;

generating from the race simulator a pre-race start signal;

determining within the race simulator a random time period, and pending for the random time period;

generating from the race simulator at the expiration of the random time period a race start signal and concomitantly initiating within the race simulator a timer;

generating at a finish line unit a finish signal, communicating the finish signal to the race simulator;

responsive to the finish signal terminating the timer; and recording, within the race simulator training statistics, the training statistics comprising at least a race event time, the race event time being an elapsed time as measured by the timer.

19. The method of claim 18, wherein the step of providing a pre-race start signal comprises:

providing a first pre-race start signal;

determining a first random time period and pending for the first random time period;

at the expiration of the first random time period providing a second pre-race start signal;

determining a second random time period and pending for the second random time period;

at the expiration of the second random time period providing a third pre-race start signal.

20. An athletic training device comprising:

a main control unit and at least one finish line unit, the main control unit and the finish line unit coupled via a communication link; and the main control unit arranged to provide a pre-race start signal and a race start signal simulating an actual event starting condition wherein the main control unit comprises a detector arranged for detecting a leaving of a start position by a training athlete, the main control unit further arranged to determine a reaction time, the reaction time being a time period between the race start signal and the leaving of the start position by the training athlete, the main control unit further arranged to time a race event, the race event comprising a time period extending between the race start signal and a race finish signal, the race finish signal being generated by the finish line unit and coupled from the finish line unit to the main control unit.

21. An athletic training device comprising:

a main control unit and at least one finish line unit, the main control unit and the finish line unit coupled via a communication link; and the main control unit arranged to provide a pre-race start signal and a race start signal simulating an actual event starting condition, the main control unit further arranged to time a race event, the race event comprising a time period extending between the race start signal and a race finish signal, the race finish signal being generated by the finish line unit and coupled from the finish line unit to the main control unit, and the main control unit further arranged to measure weather and atmospheric conditions and to store the measured weather and atmospheric conditions.

22. The athletic training device of claim 21, the main control unit arranged to store training statistics, the training statistics being correlated with the measured weather conditions.

23. An athletic training device comprising:

a main control unit and at least one finish line unit, the main control unit and the finish line unit coupled via a communication link; and the main control unit arranged to provide a pre-race start signal and a race start signal simulating an actual event starting condition, the pre-race start signal comprising a first pre-race start signal, a second pre-race start signal and a third pre-race start signal, the main control unit arranged for providing a fixed time period between the first pre-race start signal and the second pre-race start signal, a first random time period between the second pre-race start signal and the third pre-race start signal and a second random time period between the third pre-race start signal and the race start signal, the main control unit further arranged to time a race event, the race event comprising a time period extending between the race start signal and a race finish signal, the race finish signal being generated by the finish line unit and coupled from the finish line unit to the main control unit.

* * * * *